United States Patent [19]

Fulk

[11] 4,235,430

[45] Nov. 25, 1980

[54] METHOD AND APPARATUS FOR MANUFACTURING BUSINESS FORMS

[76] Inventor: James B. Fulk, P.O. Box 947, Los Gatos, Calif. 95030

[21] Appl. No.: 33,684

[22] Filed: Apr. 26, 1979

[51] Int. Cl.[3] ..... B65H 39/00

[52] U.S. Cl. ..... 270/52; 226/6

[58] Field of Search ..... 270/51–54, 270/37, 45, 4, 12, 15, 17, 18; 101/227; 226/1, 2, 4, 6, 52, 74, 108

[56] References Cited

U.S. PATENT DOCUMENTS

| | | | |
|---|---|---|---|
| 2,602,665 | 7/1952 | Fulk | 270/53 |
| 3,097,844 | 7/1963 | Huck | 270/52 |
| 3,147,006 | 9/1964 | Fulk | 101/227 X |
| 3,517,589 | 6/1970 | Herd et al. | 270/52 X |
| 3,823,934 | 7/1974 | Parewti | 270/52 X |
| 3,897,727 | 8/1975 | Fulk | 270/52 X |

*Primary Examiner*—E. H. Eickholt
*Attorney, Agent, or Firm*—Teare & Teare

[57] ABSTRACT

A method and apparatus for manufacturing business forms from rolls of paper webs. The webs are divided into at least two groups. The webs of a first group are individually processed as by printing or the like and guided into superimposed relationship. A line of holes is punched simultaneously through all of the webs of the first group, and the webs of such first group are advanced as a unit through the processing operation by a pinned belt engaging such holes. The webs of the second group are individually processed separately from the first group as by printing or the like, and are guided into superimposed relationship beneath the superimposed webs of the first group. A line of holes is punched simultaneously through all of the webs of the second group with some of the holes being in center registration with the line of holes in the first group, and the webs of both groups are advanced as a unit by a pinned belt engaging the line of holes in the webs of both groups. Thereafter, all of the webs are simultaneously further processed as by cross-perforating and stacking. All of said processing operations occur while the webs are moving continuously from said rolls.

22 Claims, 8 Drawing Figures

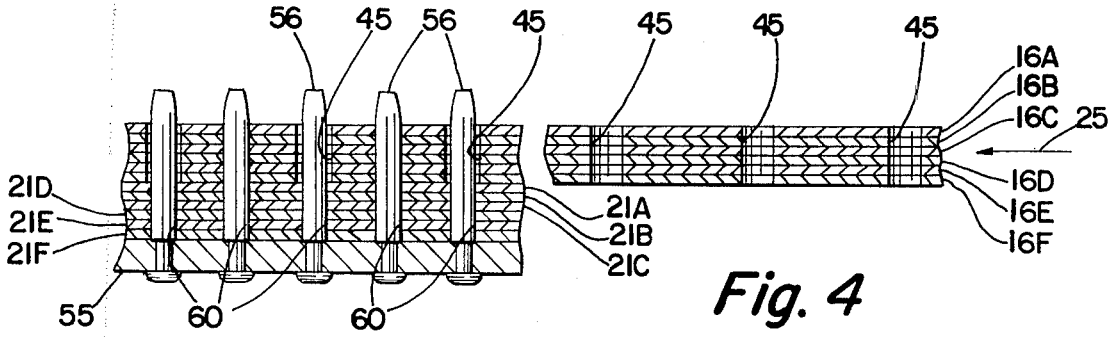
Fig. 4
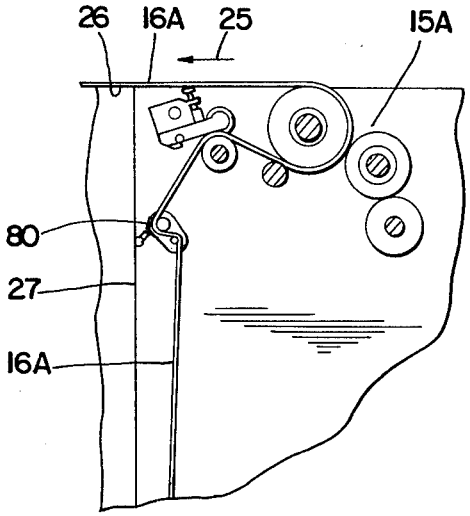
Fig. 5
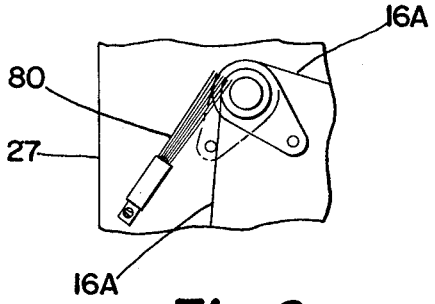
Fig. 6
Fig. 7
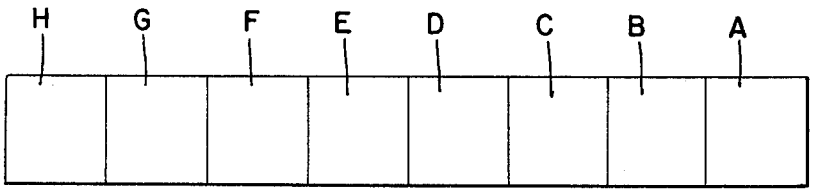

METHOD AND APPARATUS FOR MANUFACTURING BUSINESS FORMS

BACKGROUND OF THE INVENTION

Printing presses for making multiple part business forms have heretofore been made. One such press is illustrated in U.S. Pat. No. 3,147,006 which was granted to me on Sept. 1, 1964. In such machine the webs are advanced and controlled by line hole punch and pin belt mechanisms which act on the webs beyond the printing station to pull the web through such printing operation and on to further processing after they have been printed. Such mechanisms have functioned successfully for processing up to seven or eight webs at a speed of one thousand feet per minute. The demand for more parts to be printed and processed in a single machine, and the demand for more specifications on the individual webs, however, increases substantially the overall length of the machine. Such increase requires the control line hole punch mechanisms to be located farther away from the printing operation being performed on the webs, with the result that registration, esepcially the side-ways registration becomes difficult to maintain.

Such difficulty arises partly from the fact that paper is not a constant in its performance, but is affected by atmospheric conditions very readily. For example, a web of paper which is laid down in an intended straight line will curve one way or another depending upon the percentage of moisture content, and especially the moisture content adjacent the edges of the paper roll.

Another factor which contributes to the aforesaid difficulty is the fact that, as aforesaid, webs are advanced by being pulled through the processing operations, such as printing, by means of control holes and pinned belts. It has been found that after a certain distance from the printing operation to the line hole punch station, the curve of the webs affects the registration of the web parts. Such variation in the action of the paper webs can be the result of atmospheric conditions at the time of advancing the webs through the press, or the result of atmospheric conditions experienced in the storage of the rolls of paper prior to use in the press. It is augmented by any increase in distance between the web supply rolls and the web pulling or advancing mechanisms.

Thus, there has been a need for a multiple business form machine which can process a large number of webs at a high speed without lateral misalignment of the webs.

SUMMARY OF THE INVENTION

The present invention contemplates a method and apparatus which overcomes the foregoing difficulties, particularly where an unusually large number of superimposed webs are printed at relatively high speed.

In accordance with the method of the present invention, a large number of webs, such as, for example, twelve webs are pulled simultaneously and continuously off individual supply rolls. The webs are then divided into at least two groups. A punching and pin belt mechanism located subsequent to a first processing station, such as a printing station, punches holes in the first group and by the pins engaging the holes pulls the first group of webs through the first processing station where the webs are printed individually, and progressively recombined as a group.

The second group of webs bypasses the first printing station and passes through a second printing station where the webs of the second group are printed individually and progressively recombined as a group, and advanced underneath and in lateral alignment with the first group of webs.

In the preferred form of the invention a second punching mechanism located subsequent to a second processing station, such as a second printing station, punches some holes in both groups of webs and passes through the holes in the first group of webs to punch holes in the second group of webs. The pin mechanism engages at least some of said holes to advance the first group of webs in superposition over said second group of webs, and to pull the second group of webs through the aforesaid second printing station, and to advance both groups of webs through the remaining processing.

Thereafter, all of the webs are processed, as by cross-perforating and file hole punching simultaneously, and are advanced either into folders where they are zigzag folded into stacks, or into cutting devices where they are separated into single set forms. The foregoing method doubles the number of webs which can be satisfactorily processed, without increasing the problem of registration, and without diminishing the speed of the press.

BRIEF DESCRIPTION OF THE DRAWINGS

In the drawings:

FIG. 1-B is a partial fragmentary side elevation view showing the right-hand portion of the assembly, but omitting some of the supply rolls and stands;

FIG. 4 is a vertical section, on a greatly enlarged scale through superimposed webs taken on a vertical plane indicated by the line 4—4 in FIG. 3 and illustrating one form of line hole formation;

FIG. 5 is a vertical sectional view illustrating a detail of the printing mechanism;

FIG. 6 is an enlargement of part of the mechanism shown in FIG. 5; and

FIG. 7 is a schematic top plan view showing the sequence of stations from the supply rolls to the stacking.

DESCRIPTION OF THE PREFERRED EMBODIMENTS

Figure 1A:
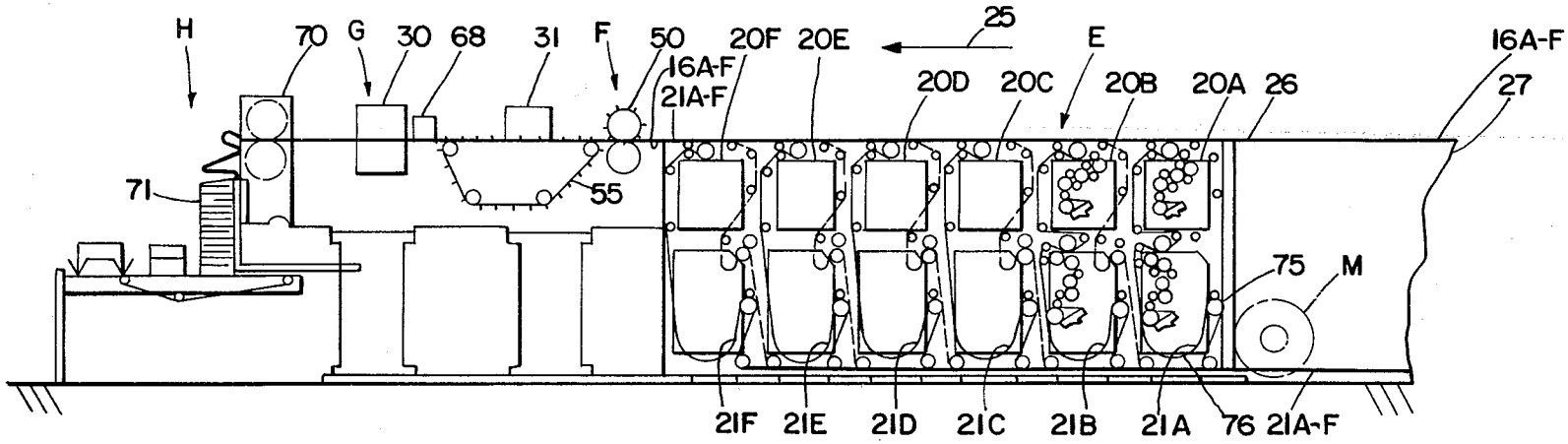
FIG. 1-A is a partial side elevation view, showing the left-hand portion, of an assembly which embodies the present invention.
Figure 1B:
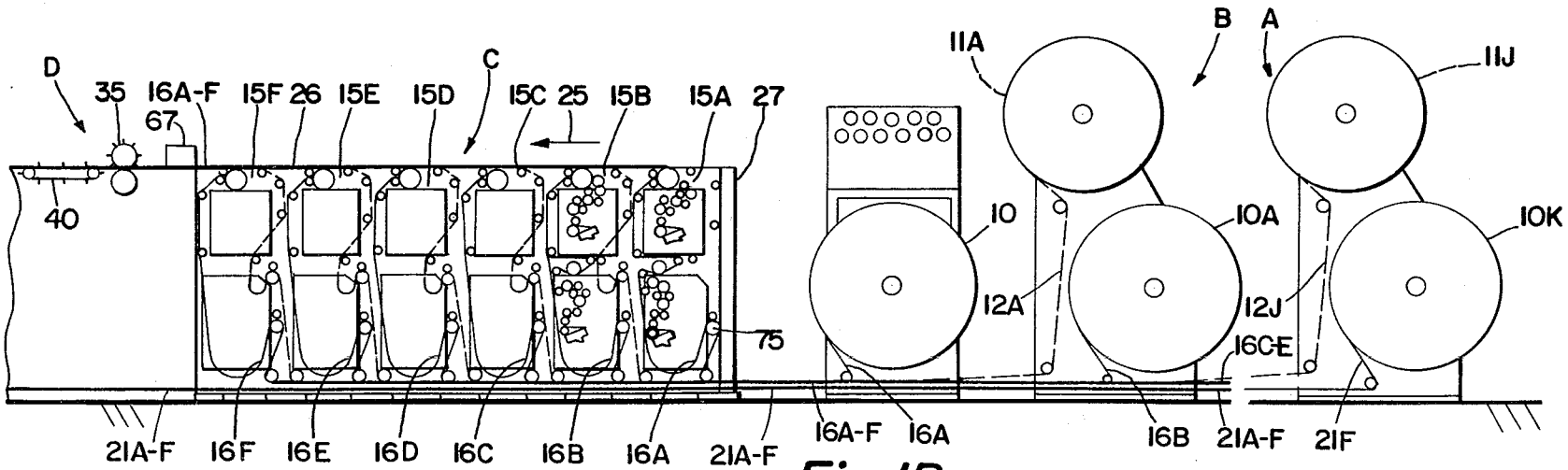

FIGS. 1A and 1B each show portions of a machine for carrying out the method of the present invention for processing a plurality of webs. At one end of the machine, shown at the right hand side of FIG. 1B a first group of webs 16A–F are pulled off a first group of unprocessed paper rolls shown generally at B into a superimposed and laterally aligned relationship (only two of such rolls, 10 and 10A being shown). A second group of webs 21A–F are pulled off a second group of unprocessed paper rolls shown generally at A into a final superimposed and laterally aligned relationship with each other with the webs of the first group (only one of such rolls, roll 10K being shown). The first group of superimposed webs 16A–16F are passed through a printing station, shown generally at C, where they are separated and individually printed and then recombined as a superimposed and laterally aligned group. The portions of the webs of the first group disposed subsequent to the first printing station C have holes punched therein at station D as by male and female die punching mechanism 35. Endless belt mechanism 40 then engages the holes to advance the first group of webs 16A–F along a straight line path, as indicated by the arrow 25, adjacent the top surface 26 of the frame 27, and to pull the first group of webs through the aforesaid first printing station.

The second group of webs, 21A–F bypass underneath the first printing station C and pass instead through a second printing station E which is in longitudinal alignment with the first printing station C. In the second printing station E, the second group of webs, 21A–F are separated, individually printed, and progressively recombined as a group. The first group of webs 16A–F, after having been printed in the first printing station C, advance into superimposed relationship and in lateral registration with the second group of webs 21A–F as the second group of webs is progressively recombined, after having been processed in the second printing station E.

A second punching and pin belt station, shown generally at F, is located subsequent to the second printing station E. At the second punching station a punching device 50, in one form of the invention, punches aligned holes in both the first 16A–F and second 21A–F group of webs, and also passes through the holes of the first group 16A–F webs to punch concentric holes in the second group of webs. A pin belt 55 engages at least some of the holes to pull the second group of webs through the second printing station E and to pull the first group of webs into superimposed relationship with the first group of webs. The combined first and second groups of webs then advance to a further processing station G, such as a cross-perforation 30 and a stacking station H.

As shown in FIG. 1B, the web supply portion of the apparatus includes a first web supply section B and a second web supply section A. The sections are shown broken away, and only two rolls, 10 and 10A of the first section B, and one roll 10K of the second section A are shown. It is understood that four additional rolls for the first section and five additional rolls for the second section would be provided. The total number of rolls should correspond to the total number of webs to be processed. Also, as shown in FIG. 1B, rolls of carbon paper may be employed for interleaving with the paper webs, as desired. Only two rolls are illustrated, one of which is designated 11A which provdies a web 12A for interleaving between paper webs 16A and 16B, and the other of which provides a web 12J for interleaving between paper webs 21E and 21F.

The present invention is illustrated in FIGS. 1A and 1B on wherein the printing units are mounted adjacent one another, and wherein an electric motor M is operatively connected in timed relationship to all of the operating parts in a manner well known in the art. One of such parts comprises the line hole rotary punching device 35, and the pinned belt 40. The pinned belt 40 operates to advance the webs of the first group, as a unit, through the processing units of section B and through the punching device 35. The pins on the belt 40 enter the line holes 45 made by the punching device and exert a pulling action on the webs of the first group. Such webs are shown, on a greatly enlarged scale at the right in FIG. 4, at 16A to 16F inclusive.

Figure 2:
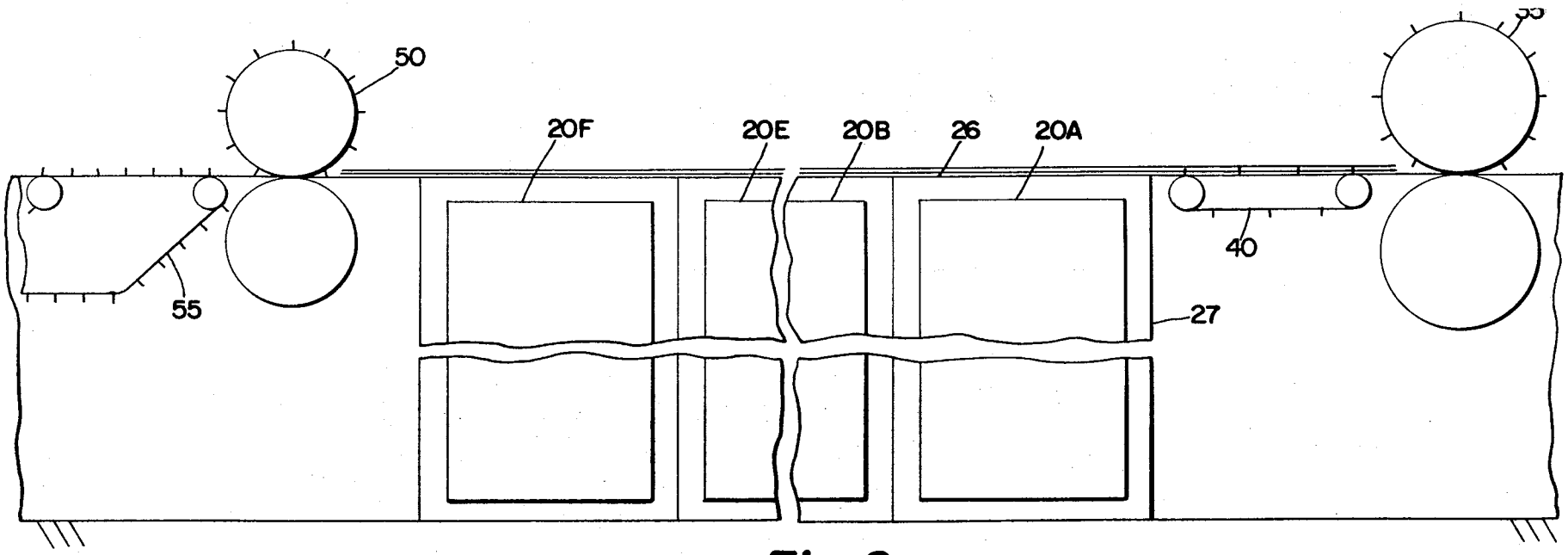
FIG. 2 is a diagramatic side view of a portion of the assembly, illustrating the line hole punching and pulling and advancing mechanisms.

Another of such parts comprises the line hole rotary punching device 50, and a pinned belt 55, which are also illustrated in FIG. 1–N and FIG. 2. The pinned belt 55 operates to advance the webs of the second group as a unit through the processing units of section C, and also operates to advance the combined superimposed webs of the first and second groups through the punching device 50. The pins 56 on the belt 55 enter the line holes 60 made by the punching device 50 and also enter the line holes 45 made by the punching device 35, and exert a pulling action on the webs of both groups. At the left in FIG. 4, the webs of both groups are shown in superimposed relationship above the pinned belt 55, which advances and controls the webs for further simultaneous processing on all of them as a unit. Such processing can be accomplished, for example, by a cross-perforator 30 or a file hole puncher 31. After cross-perforating, the webs are advanced as a unit into a folder 70 for stack delivery at 71, or into a cut-off device (not shown) for delivery as single set forms. If desired, the webs of the first group may be fastened together by a crimplock device indicated at 68 in FIG. 1-A.

Figure 3:
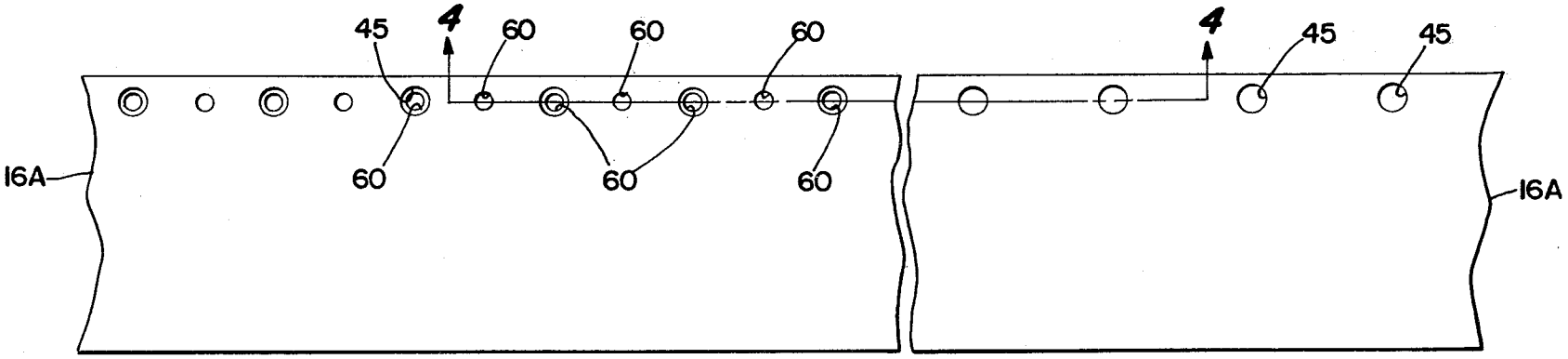
FIG. 3 is a fragmentary top plan view of superimposed webs having lines of holes punched therein in accordance with one form of the invention along one edge of the webs.

In FIGS. 3 and 4 the line holes 45 are shown as being larger in diameter than the line holes 60. This is the preferred arrangement so as to allow adequate clearance for the teeth on the punching unit 50 to clear the walls of such holes as they pass through them before punching the line holes 60 in the webs of the second group. In practice, where the center-to-center spacing of the line holes in the finished product is one-half inch, the teeth on the punching unit 35 may be spaced apart a center-to-center distance of one-inch, and the diameter of each tooth may be 6/32 inches. The teeth on the punching unit 50 may be spaced apart a center to center distance of ½ inch, and the diameter of each tooth may be 5/32 inches. Thus, alternate teeth on the punching unit 50 will pass through the holes 45 in the webs of the first group before punching the 5/32 inch holes 60 in the webs of the second group. The remaining alternate teeth on the punching unit 50 will punch 5/32 inch holes 46 in the webs of the first group, and, continuing on, will punch 5/32 inch holes 60 in the webs of the second group.

Although the foregoing arrangement of line hole formation is preferable, nevertheless other arrangements may be used, if desired. For example, the first line hole punch 35 may be made to punch holes 5/32 inches in diameter, every ½ inch, or may be made to punch holes 6/32 or 7/32 inches in diameter spaced ½ inch apart. In every case, the pins on the belt 40 are made to accommodate the size and spacing of the holes made by the punching unit 35. Notwithstanding the foregoing variations in size and spacing of the teeth in the punching unit 35, the 1/2" spacing of 5/32 inches in diameter teeth on the punching unit 50 will remain unchanged.

The printing units 15A to 15F and 20A and 20F are shown generally, but it is to be understood that the composition may be varied to suit any desired specification. Thus, one or more of the units may be arranged to print a two color face, or one color face and one color back for any or all webs. In any event, proper degree of tautness suitable for printing can be maintained while utilizing the method of the present invention. One such controlling mechanism includes power actuated coacting feed rollers 75, which are the same for each printing unit, and each of which operates to pull a web from one of the supply rolls and to advance it in the form of a festoon 76 into the printing unit. The webs are then advanced through the printing units by the pinned belts 40 and 55 respectively, during which time each web is engaged by a drag brush 80 which is adjusted to assure adequate smoothness of the web for optimum printing conditions, as is well known in the art. An electric eye (not shown) acting on each festoon maintains proper feed of each web.

The operation of a press in accordance with the method of the present invention is as follows:

Assuming that webs of paper have been withdrawn from the supply rolls on the unit A and have been threaded through the respective printing units on sections B and C, and assuming further that the webs in section B have been passed through the punching mechanism 35 and onto the pinned belt 40, and placed in superimposed relationship on the top surface 26 of the frame 27, while the webs in section C have been placed in superimposed relationship beneath the webs of section B along the top surface 26 of the frame 27, and that all of the webs have been passed as a unit through the punching mechanism 50 and onto the pinned belt 55, then upon operation of the motor M, all of the webs will be pulled in unison by the respective feed rolls 75 from the supply rolls, with the webs 16A–F moving into and being printed by the respective printing units 15 A–F of section B, and the webs 21 A–F moving into and being printed by the respective printing units 20 A–F of section C. The pinned belt 40 pulls the webs 16 A–F through the printing units of section C and advances them into superimposed relationship into the punching device 35. The pinned belt 55 pulls the webs 21 A–F through the printing units of section E and advances them into superimposed relationship with each other and with the superimposed webs 16 A–F, into the punching device 50. The pinned belt 55 also advances all of the superimposed webs onto the processing section G, where they are processed simultaneously, as by cross-perforating at 30 and file-hole punching at 31. Thereafter, all of the webs are advanced as a unit into a folder 70 which folds them into stacks 71 of zig-zag form. If desired, the webs, instead of being folded, may be cut into single set forms by a cutting device (not shown) as is well known in the art.

An advantage of the method and apparatus of the present invention is that production may be doubled, because the distance between the printing units and the web advancing means is maintained sufficiently short that the press may be operated at a speed of about one thousand feet per minute without diminishing accuracy in exact predetermined lengths, and without incurring objectionable weaving of the webs while they are moving in superimposed relationship.

Although the invention is shown as printing twelve webs in sections of six webs each, it is to be understood that such numbers are not restrictive, so long as the web advancing means can operate to pull the webs satisfactorily at the desired speed.

I claim:

1. A method of producing a plurality of processed paper web units of business forms in a continuous operation from a plurality of supply rolls of unprocessed paper webs comprising;

advancing at least a first group of webs from some of the supply rolls into and through at least a first group of processing units, processing the webs in said first group of webs in said respective processing units while they are moving therethrough, advancing the webs of said first group in superimposed relationship along a common straight line path, forming a line of holes in all of the webs in said first group in a direction extending longitudinally of said straight line path, and while said webs are moving in superimposed relationship, advancing at least a second group of webs from other of said supply rolls into and through at least a second group of spaced processing units, processing the webs in said second group of webs in the respective units of said second group of processing units while they are moving therethrough.

advancing the webs of said second group in superimposed relationship with each other and with the superimposed webs of said first group and along said common straight line path, forming a line of holes in all of the webs of said second group, along a straight line coincident with said line of holes formed in the first group of webs, while all of said webs of both groups are moving in superimposed relationship, and thereafter performing a further processing operation simultaneously upon all of the webs of both groups.

2. The method of claim 1 comprising forming a festoon in each web while it is advancing into a processing unit and exerting a drag force on each web adjacent the point of entry into the processing unit, whereby the web is maintained sufficiently taut for processing while moving through the processing unit.

3. The method of claim 1 comprising passing all of the webs of said second group of webs beneath the units of said first group of processing units as they are advancing from the supply rolls into the second group of processing units.

4. The method of claim 1 comprising forming the line holes in the webs of the first group of a size which is different from the size of the line holes in the webs of the second group.

5. The method of claim 4 wherein the line holes in the webs of the first group are larger in size than the line holes in the webs of the second group.

6. The method of claim 1 comprising, forming the line holes in the webs of the first group of the same size as the line holes in the webs of the second group.

7. The method of claim 1 comprising, forming the line holes in the webs of the first group on a center to center spacing which is different from the center to center spacing of the line holes in the webs of the second group.

8. The method of claim 1 comprising, forming the line holes in the webs of the first group initially twice as far apart, on center to center spacing, as the line holes in the webs of the second group and subsequently forming additional line holes in the webs of the first group to make the center to center spacing of the line holes in the webs of the first group, the same as the center to center spacing of the line holes in the webs of the second groups.

9. The method of claim 1 comprising, forming the line holes in the webs of the first group on the same center to center spacing as the line holes in the webs of the second group.

10. The method of claim 1 comprising, advancing the webs of the first group through the processing units of the first group by exerting a pulling force on all of the webs of the first group as a unit after the line holes have been formed therein and before the webs of the first group are moved into superimposed relationship with the webs of the second group.

11. The method of claim 10 comprising, advancing the webs of the second group through the processing the units of the second group by exerting a pulling force on all of the webs of the second group, as a unit, after the line holes have been formed therein, and while the webs of the first group are moving in superimposed relationship with the webs of the second group.

12. The method of claim 1 comprising, forming some of the line holes in the webs of the first group before the webs of the first group are moved into superimposed relationship with the webs of the second group and forming additional line holes in the webs of the first group simultaneously with the formation of all of the line holes in the webs of the second group.

13. The method of claim 1, wherein the webs are advanced by exerting force upon the confronting web surfaces defined by the holes.

14. Apparatus for producing a plurality of processed paper web units of business forms in a continuous operation from a plurality of supply rolls of unprocessed paper webs comprising in combination, a frame, a plurality of supply rolls of unprocessed paper webs supported at one end of the frame, a first group and a second group of web processing units mounted within said frame, means for advancing a first group of webs into the respective units of said first group of processing units, means for advancing a second group of webs into the respective units of said second group of processing units, means for punching a line of holes in said superimposed webs of said first group simultaneously in a direction extending longitudinally of the webs, means for advancing the processed webs of said second group into superimposed relationship with each other and with the superimposed webs of said first group of webs, means for punching a line of holes in said superimposed webs of said second group of webs, simultaneously in a direction extending longitudinally of said webs, means for processing all of said webs as a unit simultaneously while they are disposed in superimposed relationship, and means for operating all of said advancing, processing and punching means in co-acting timed relationship.

15. The apparatus of claim 14 wherein the means for punching the line holes and advancing the first group of webs into superimposed relationship is mounted on the frame between the first group of processing units and the second group of processing units.

16. The apparatus of claim 15 wherein the means for punching the line holes and advancing the second group of webs into superimposed relationship is mounted on the frame between the second group of processing units and the means for processing all of the webs as a unit simultaneously.

17. The apparatus of claim 14 wherein the first mentioned punching means produce line holes which are larger in size than the line holes produced by the second mentioned punching means.

18. The apparatus of claim 14 wherein the first mentioned punching means produce line holes which are the same in size as the line holes produced by the second mentioned punching means.

19. The apparatus of claim 14 wherein the first mentioned punching means produce line holes which are spaced farther apart than the line holes produced by the second mentioned punching means.

20. The apparatus of claim 14 wherein the first mentioned punching means produce line holes which are spaced the same distance apart as the line holes produced by the second mentioned punching means.

21. The apparatus of claim 14 wherein synchronization means coordinates the operation of the first and second punching means, whereby the second mentioned punching means punches holes in the second group of webs concentrically with the holes made by the first punching means in the first group of webs.

22. The apparatus of claim 14 wherein the means for advancing the processed webs includes pin means mounted on driven belts and wherein the pin means exert force upon the confronting web surface defined by the holes punched in said webs.

* * * * *